US006030262A

United States Patent [19]

Okamoto et al.

[11] Patent Number: 6,030,262

[45] Date of Patent: Feb. 29, 2000

[54] FUEL SYSTEM FOR AN ENGINE POWERING AN OUTBOARD MOTOR

[75] Inventors: Yutaka Okamoto; Masanori Takahashi; Noriyoshi Hiraoka, all of Hamamatsu, Japan

[73] Assignee: Sanshin Kogyo Kabushiki Kaisha, Hamamatsu, Japan

[21] Appl. No.: 08/975,744

[22] Filed: Nov. 20, 1997

[30] Foreign Application Priority Data

Jul. 17, 1987 [JP] Japan ..... 9-207435
Nov. 20, 1996 [JP] Japan ..... 8-323323

[51] Int. Cl.[7] ..... B63H 21/10

[52] U.S. Cl. ..... 440/88; 123/495

[58] Field of Search ..... 440/88; 123/495, 123/496, 509

[56] References Cited

U.S. PATENT DOCUMENTS 5,036,822 8/1991 Kojima ..... 123/509
5,404,858 4/1995 Kato ..... 123/516
5,450,831 9/1995 Fukuoka ..... 123/509
5,511,956 4/1996 Hasegawa et al. ..... 123/496
5,669,358 9/1997 Osakabe ..... 123/509
5,701,872 12/1997 Katu et al. ..... 123/495

*Primary Examiner*—Jesus D. Sotelo
*Attorney, Agent, or Firm*—Knobbe, Martens, Olson & Bear LLP

[57] ABSTRACT

A fuel system arrangement for an engine positioned in a cowling of an outboard motor is disclosed. The engine has a first end and a second end and comprises a cylinder block with a cylinder head connected to the cylinder block at the first end of the engine and cooperating therewith to define at least one combustion chamber, and a crankcase positioned at the second end of the engine. The engine includes an intake system for providing air to the combustion chamber, the intake system including at least one intake runner extending along a side of the engine defined between the first and second ends, the runner having a passage therethrough leading to a passage extending through the cylinder head to the combustion chamber. The fuel system includes a fuel supply unit for delivering fuel from a fuel supply to at least one charge former, the charge former arranged to provide fuel to the combustion chamber for combustion therein, the fuel supply unit positioned at the first or second end of the engine.

6 Claims, 9 Drawing Sheets

FUEL SYSTEM FOR AN ENGINE POWERING AN OUTBOARD MOTOR

FIELD OF THE INVENTION

The present invention is an arrangement for an engine powering an outboard motor. In particular, the present invention is a fuel system arrangement for such an engine.

BACKGROUND OF THE INVENTION

As is well known, outboard motors for use in powering watercraft include an engine powering a water propulsion apparatus of the motor, such as a propeller. These outboard motors have a cowling in which is positioned the engine.

The motor is generally movably mounted to a stern of a watercraft, and as such, it is desirable that the motor be compact in dimension. Keeping the motor compact reduces air drag and reduces the force necessary to turn or trim the motor. In order that the outboard motor be small in dimension, however, the engine must powering the motor must also be compact in arrangement.

Several problems exist in achieving this desired compact engine arrangement when considering features of the engine which are external to the cylinder block and head. One way to reduce the size of the engine is to reduce the size of the intake system, such as by shortening intake pipes and decreasing their radius of curvature. This solution, however, may reduce air flow to the engine, decreasing engine output and increasing harmful engine emissions.

Another problem is that the various engine components, such as fuel system components, are generally not mounted symmetrically about the engine. This either necessitates that the motor cowling have an irregular shape or that it be symmetrical and be much larger than the total volume occupied by the engine.

An arrangement for an engine powering an outboard motor which overcomes the above-stated problems and which is compact is desired.

SUMMARY OF THE INVENTION

The present invention is a fuel system arrangement for an engine positioned in a cowling of an outboard motor. The engine is preferably of the type which comprises a cylinder block, a cylinder head positioned at a first end of the engine and cooperating with the cylinder block to define at least one combustion chamber, and a crankcase positioned at an opposing second end of the engine. The engine includes an intake system for providing air to the combustion chamber, the intake system including at least one intake runner extending along a side of said engine defined between the first and second ends thereof, the runner having a passage therethrough leading to a passage extending through the cylinder head to the combustion chamber.

The fuel system includes a fuel supply unit for delivering fuel from a fuel supply to at least one charge former, the charge former arranged to provide fuel to the combustion chamber for combustion therein, the fuel supply unit positioned at the first or second end of the engine.

In a preferred embodiment of the invention, the fuel supply unit includes a first pump, a vapor separator, and a second pump. The first pump draws fuel from the fuel supply and delivers it to the vapor separator, and the second pump delivers the fuel from the vapor separator to the charge former.

In one arrangement, the intake system includes a surge tank positioned at the second end of the engine, with the runner extending from the surge tank along the side of the engine to the cylinder head. The fuel supply unit is positioned between the surge tank and the crankcase at the second end of the engine.

The positioning of the vapor separator at the either end of the engine permits the engine to be arranged symmetrically about a centerline extending through the ends of the engine and have a small width. In addition, this arrangement permits the intake system to have a large surge tank and long runners with a small radius of curvature, promoting efficiency of the engine at low speed and reducing the overall friction losses through the intake system.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention relates to an engine utilized to power an outboard motor. In general, the engine has a fuel system arranged to provide for a compact, generally symmetrical engine arrangement and which allows for an efficient intake system arrangement. The engine arrangement of the present invention is described in conjunction with an outboard motor since this is an application for which the engine has particular utility. Those of skill in the art will appreciate an engine as arranged in accordance with this invention may have utility in a wide range of other applications.

Figure 1:
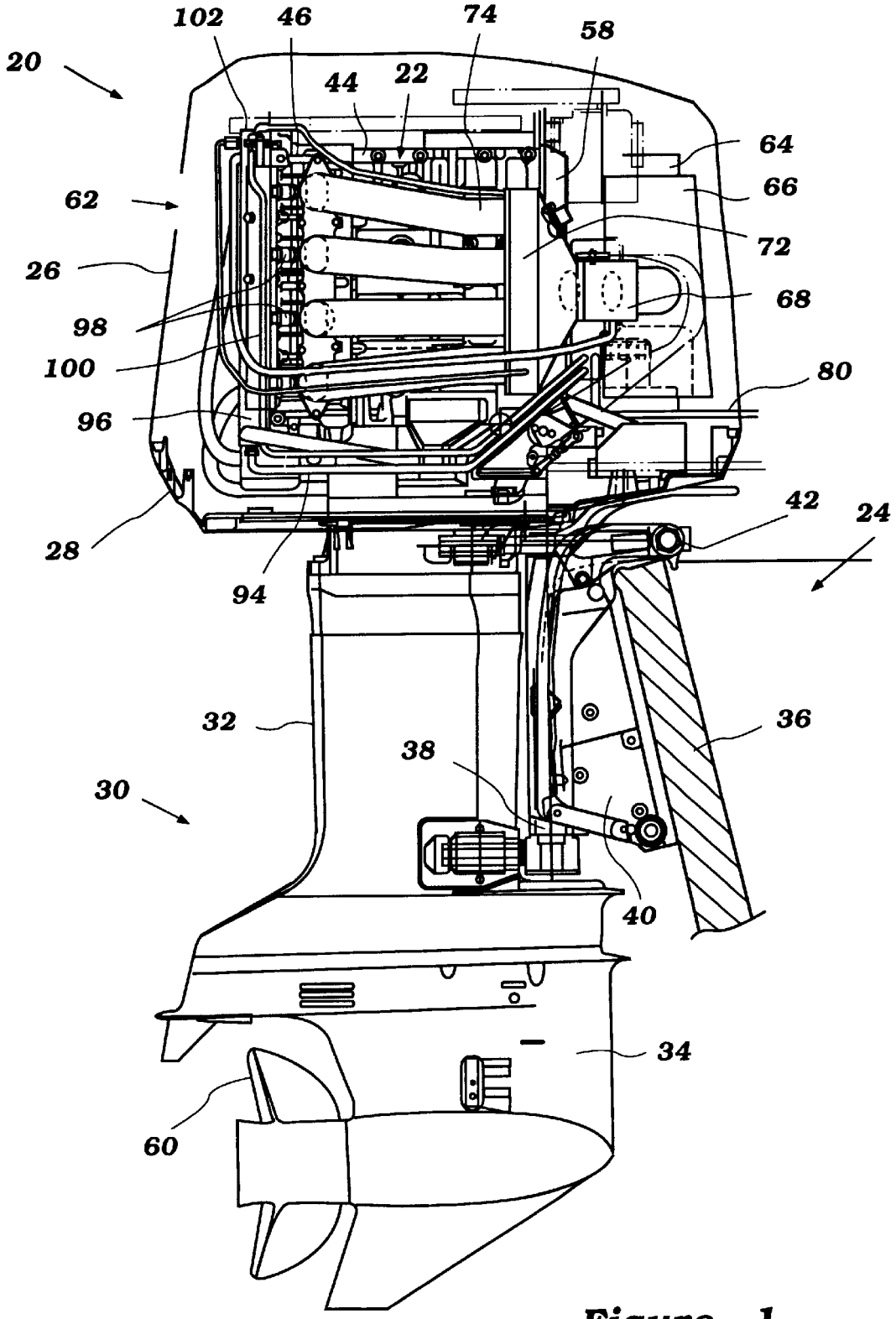
FIG. 1 is a cross-sectional side view of an outboard motor connected to a watercraft, the motor powered by an engine arranged in accordance with the present invention.

FIG. 1 illustrates an outboard motor 20 powered by an internal combustion engine 22. The motor 20 is arranged to propel a watercraft 24. The outboard motor 20 has a powerhead comprised of a cowling 26 and a tray part 28 positioned therebelow. A lower unit 30 extends below the powerhead. The lower unit 30 preferably includes an upper or drive shaft housing portion 32 and a lower part 34.

The motor 20 is preferably movably mounted to a transom 36 of the watercraft 24. Preferably, a steering shaft (not shown) is connected to the motor 20. The steering shaft is supported for steering movement about a vertically extending axis within a swivel bracket 38. This mounting permits the motor 20 to be turned about the vertically extending axis passing through the steering shaft for steering the watercraft 24.

The swivel bracket 38 is connected to a clamping bracket 40 about a generally horizontally extending pin 42. The clamping bracket 40 is connected to the transom 36 of the watercraft 24. The mounting about the pin 42 permits the motor 20 to be trimmed or tilted up and down in a vertical plane about a horizontal axis extending through the pin 42.

The engine 22 is positioned within the cowling 26 of the motor 20. The engine 22 is preferably of the four-cylinder, inline variety, operating on a four-cycle operating principle. As may be appreciated by those skilled in the art, the engine 22 may have a greater or lesser number of cylinders, may be arranged in other than in-line fashion and may operate on other operating principles, such as a two-cycle principle.

Figure 3:
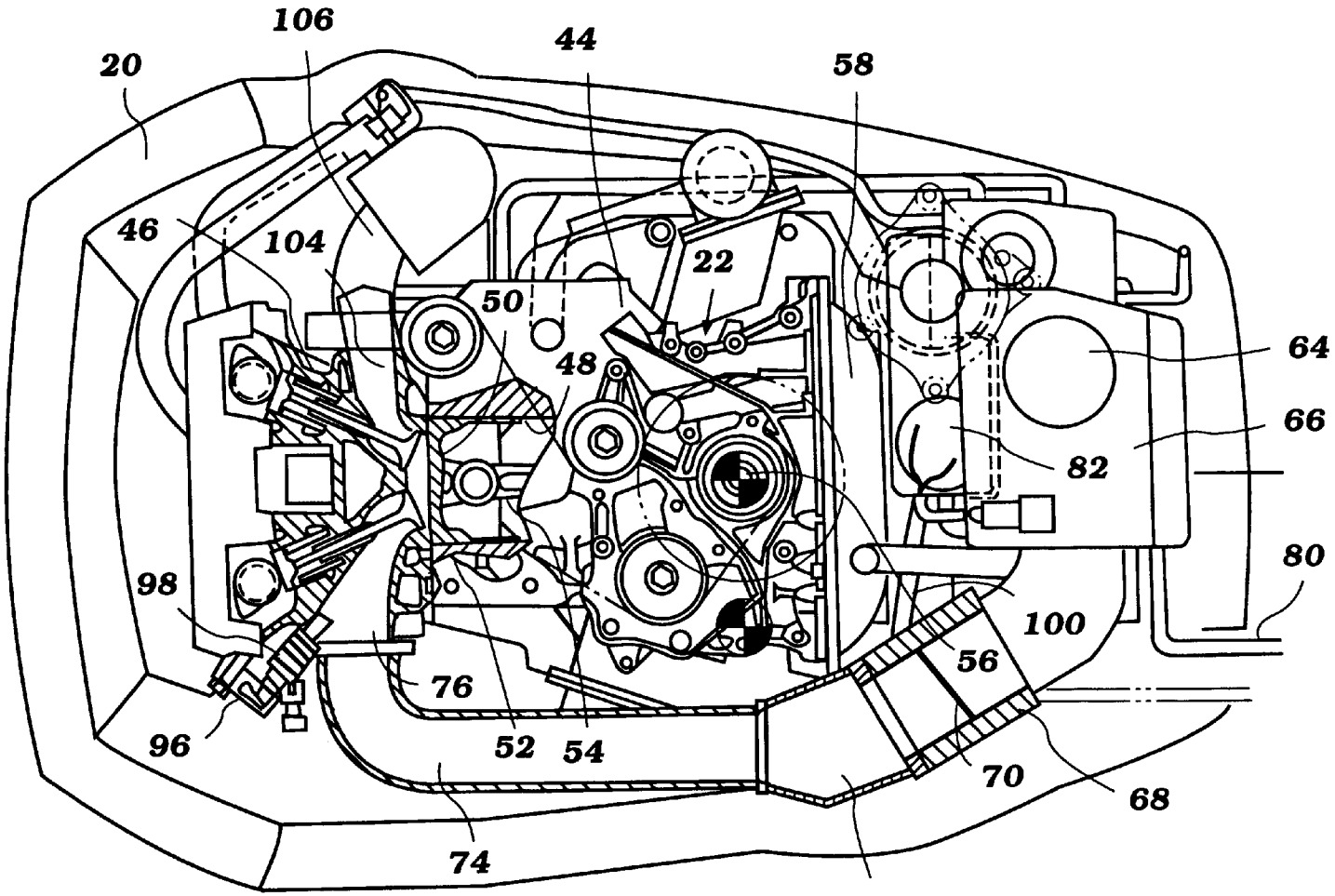
FIG. 3 is a top cross-sectional view of the engine illustrated in FIG. 2.

The engine 22 preferably comprises a cylinder block 44 having a cylinder head 46 connected thereto and cooperating therewith to define the four cylinders 48 (see FIG. 3). Referring to FIG. 3, a piston 50 is movably mounted in each cylinder 48 and cooperates with the cylinder head 46 and block 44 to define a combustion chamber 52.

Each piston 50 is connected, via a connecting rod 54, to a generally vertically extending crankshaft 56. As illustrated, the crankshaft 56 is preferably mounted for rotation with respect to the cylinder block 44 at an end thereof generally opposite the cylinder head 46. The crankshaft 56 is positioned in a crankcase defined by the cylinder block 44 and a crankcase cover 58. As illustrated, the engine 22 is preferably arranged so that the cylinder head 46 is positioned at a first end of the engine 22 which faces away from the watercraft 24 to which the motor 20 is connected. In this arrangement, the crankcase is at a second, opposing end of the engine 22 closest the watercraft 24.

The crankshaft 56 extends to a point below the engine 22 where it is connected to a drive shaft (not shown). The drive shaft extends through the lower unit 30 of the motor 20 and is arranged to drive a water propulsion device of the motor 20. As illustrated, the water propulsion device is a propeller 60. Preferably, the drive shaft drives a propeller shaft connected to the propeller 60 through a forward-neutral-reverse transmission as known to those of skill in the art.

Figure 2:
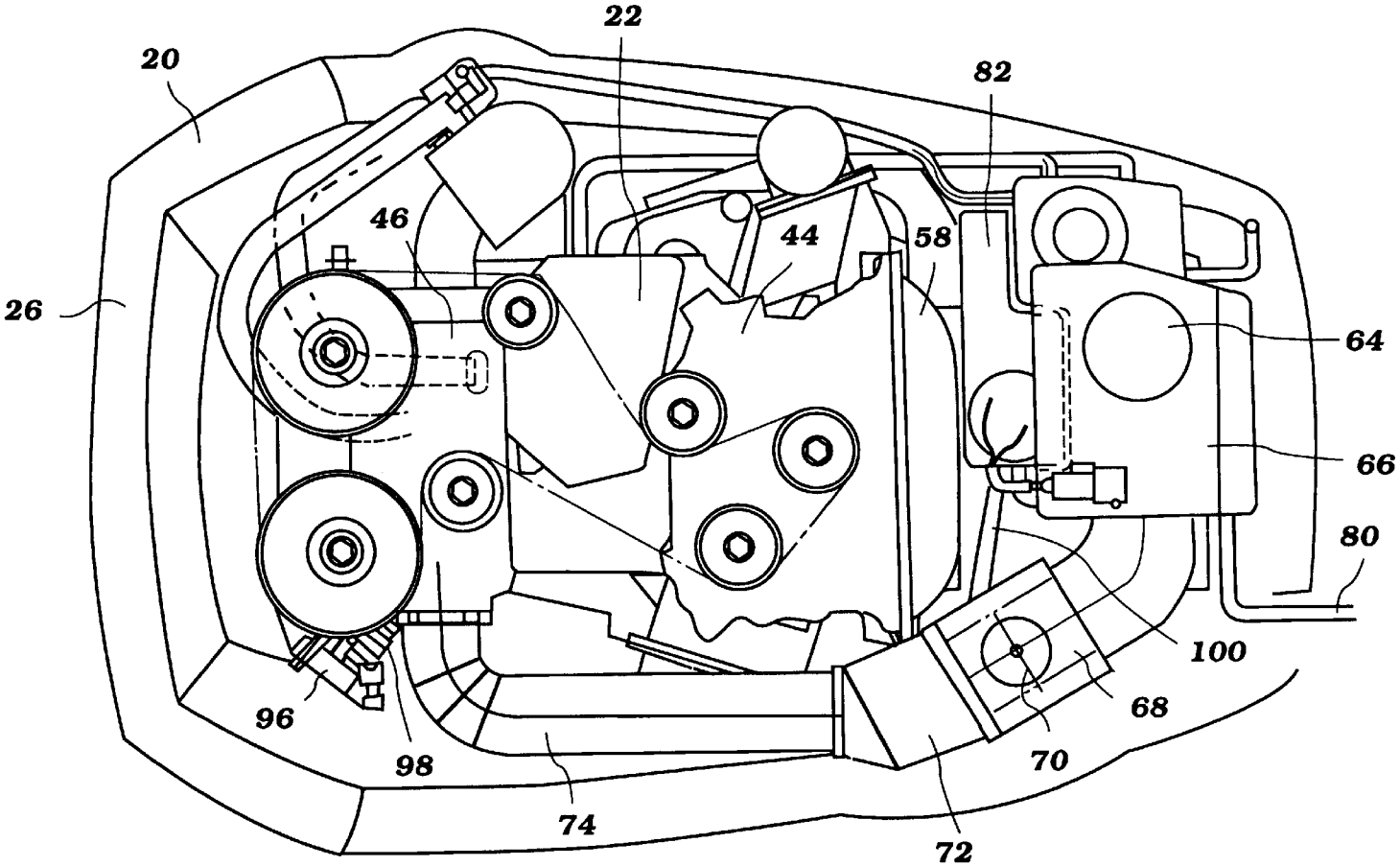
FIG. 2 is a top view of the engine illustrated in FIG. 1, with a cowling of the motor illustrated in cross-section.

An air intake system provides air to each cylinder 48 for use in a fuel combustion process. Referring to FIGS. 1–3, the air intake system includes an air vent 62 in the cowling 26 through which air is drawn. Air within the cowling 26 is drawn through an air intake port 64 into a silencer 66. As illustrated, the silencer 66 is a large volume tank positioned at the end of the engine 22 opposite the cylinder head 46 and thus adjacent the crankcase cover 58. The intake port 64 extends upwardly from the silencer 66.

An air passage leads from the silencer 66 to a throttle body 68 having a passage therethrough. A throttle valve 70 is positioned in the passage through the throttle body 68 for controlling the flow of air therethrough. Preferably, the throttle valve 70 comprises a butterfly-type plate as known to those of skill in the art, the plate remotely movable by an operator of the watercraft 24 via a throttle control or similar mechanism.

Air which passes through the passage through the throttle body 68 past the valve 70 flows into an expanded volume surge tank 72. Preferably, the throttle body 70 is positioned near one corner of the engine 22 adjacent the silencer 66, and the surge tank 72 is positioned along a side of the engine 22 between its ends. An intake runner 74 extends from the surge tank 72 to an intake passage 76 leading through the cylinder head 46 to each cylinder 48 (i.e. in this embodiment of the invention, there are four intake runners 74, one runner 74 each corresponding to a single of the cylinders 48 of the engine 22). The runners 74 extend along a side of the engine 22 from the surge tank 72 positioned near the crankcase end to the cylinder head 46 positioned at the opposite end of the engine 22.

Figure 4:
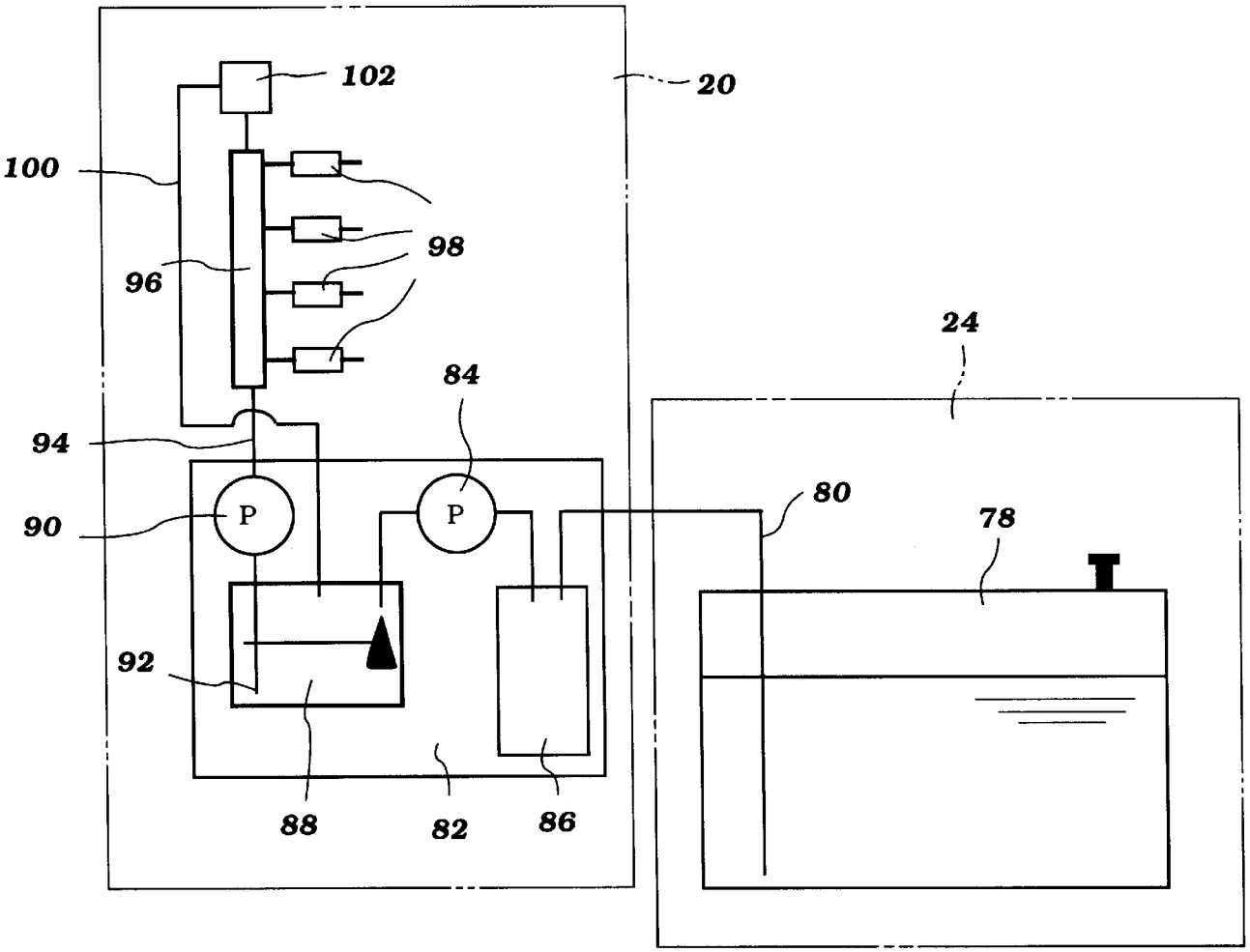
FIG. 4 schematically illustrates a fuel supply system of the engine illustrated in FIG. 1.

A fuel supply system provides fuel to the combustion chambers 52 of the engine 22 for combustion therein and driving of the pistons 50. The fuel system is illustrated schematically in FIG. 4, while FIGS. 1–3 illustrate specific portions of the system as they relate to the engine arrangement of this embodiment of the invention.

Fuel is drawn from a fuel supply, such as a reservoir 78 positioned in the watercraft 24, by a fuel supply unit 82. Preferably, the fuel supply unit 82 is mounted near the engine 22 in the cowling 26. The fuel supply unit 82 includes first pump means in the form of a low pressure pump 84 which draws fuel from the reservoir 78 through a fuel supply line 80. Preferably, fuel is drawn through a water separator and/or similar filter 86 positioned between the pump 84 and reservoir 78.

The low pressure pump 84 delivers the fuel to a vapor separator 88 of the fuel supply unit 82. Second pump means, such as an electrically powered high pressure pump 90, draws fuel from the separator 88 through an inlet 92 and delivers it under high pressure into a delivery line 94 which leads to a fuel rail 96. Individual fuel injectors 98 are provided corresponding to each cylinder 48. Fuel is supplied to each injector 98 through the fuel rail 96 and then delivered into the combustion chamber 52 of each cylinder 50.

Fuel which is supplied to the fuel rail 96 but which is not supplied to the engine 22 by the fuel injectors 98 is preferably returned to the vapor separator 88 through a return line 100. A pressure regulator 102 is provided along the line 100 for maintaining the fuel at high pressure within the fuel rail 96 and yet permitting the undelivered fuel to be returned to the separator 88.

The fuel supply unit 82 may comprise a housing enclosing the filter 86, low and high pressure pumps 84,90 and vapor separator 88.

Referring to FIGS. 1–3, the fuel supply unit 82 is mounted at the crankcase or second end of the engine 22. Preferably, the fuel supply unit 82 is positioned between the crankcase cover 58 and the silencer 66. In this embodiment, the high pressure delivery line 100 extends from the fuel supply unit 82 along the side of the engine 22 generally parallel to the intake runners 74 to the fuel rail 96. The fuel rail 96 extends vertically along the cylinder head 46 of the engine 22, with the injectors 98 spaced therealong. Each injector 98 has its delivery end extending through the cylinder head 46 into one of the intake passages 76 leading to a cylinder 46.

Exhaust generated by the combustion process is routed from each cylinder 48 through an exhaust passage 104 leading through the cylinder head 46. Each exhaust passage 104 leads to an exhaust pipe 106. The exhaust pipe 106 routes exhaust from the exhaust passages 104 to a point external to the motor 20, such as an above or below water exhaust port.

This embodiment of the engine 22 has the advantage that the fuel supply unit 82 is positioned at the end of the engine, keeping the width of the motor 20 small. This reduces the profile of the motor 20, lowering the air drag associated therewith. In addition, the location of the unit 82 at the crankcase end of the engine 22 permits the intake runners 74 to extend along the side of the engine 22. The extension of the runners 74 along the side of the engine 22 coupled with the location of the silencer 66 at the end of the engine permits the runners 74 to have a long effective length, increasing engine performance in the low speed range.

The overall length of the engine 22 is not unduly increased, even though the silencer 66 is positioned at the end of the engine 22. In particular, the silencer 66 is made smaller than normal. The intake system does not suffer as a result of the smaller sized silencer 66, since a surge tank 72 is also provided, resulting in a large volume of contained intake air. Thus, of its reduced size, the silencer 66 can be positioned at the end of the engine 22, increasing the effective length of the intake pipes or runners 74. In addition, because the silencer 66 is spaced slightly outward from the end of the engine, the radius of curvature of the intake passage leading therefrom around to the side of the engine is reduced, reducing frictional losses and increasing engine performance.

Another advantage of this arrangement is that the fuel system components are symmetrically positioned along a centerline extending though the engine 22 from end to end. This permits use of a small cowling without wasted space.

Figure 5:
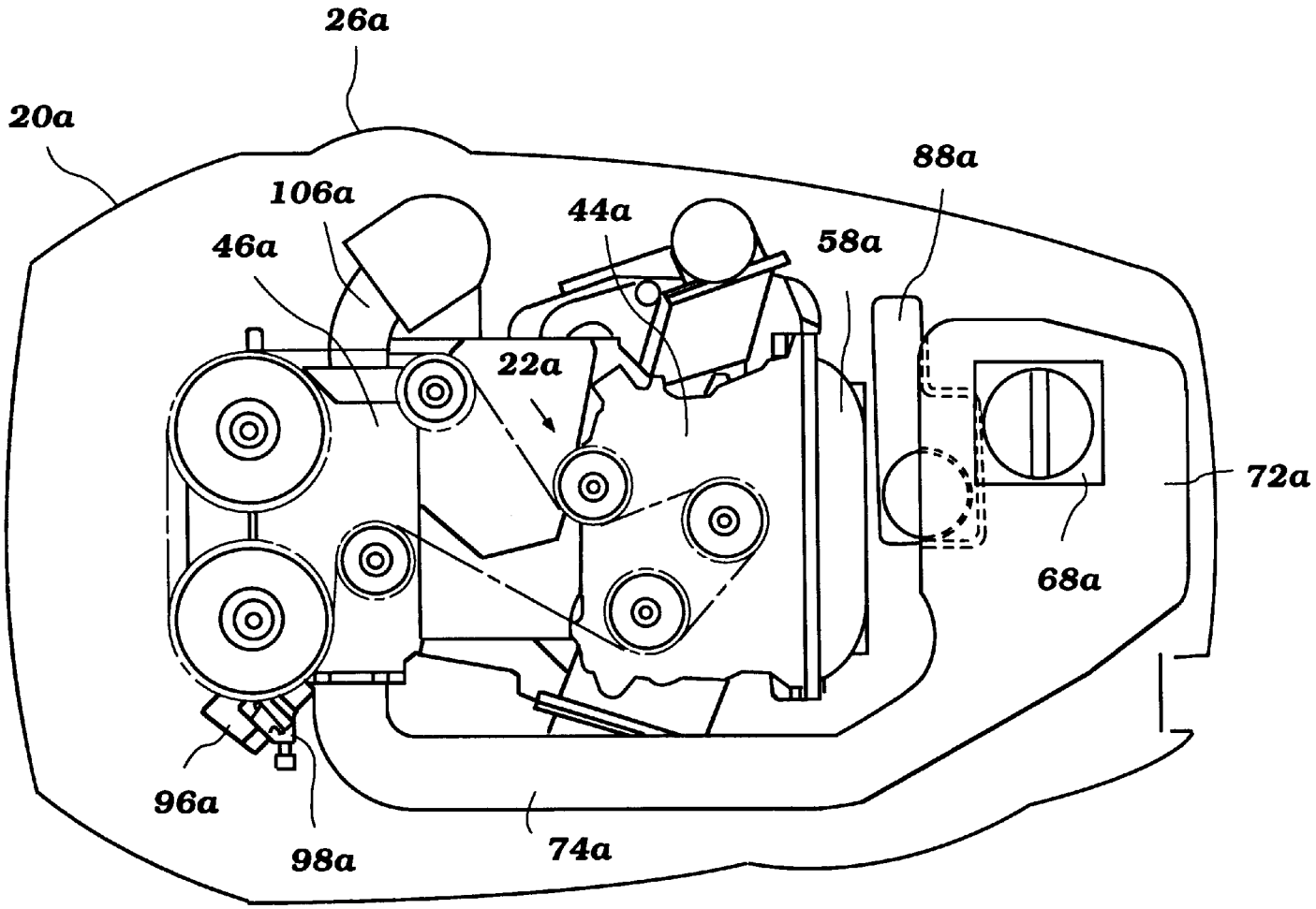
FIG. 5 is a top view of an engine arranged in accordance with a second embodiment of the present invention, with a cowling of a motor in which the engine is positioned illustrated in cross-section.

FIG. 5 illustrates an engine 22*a* arranged in accordance with a second embodiment of the present invention and utilized to power an outboard motor 20*a*. In the description and illustration of this embodiment, like reference numerals are used with like or similar parts to those used in the description and illustration of the first embodiment, except that an "a" designator has been added to all reference numerals of this embodiment.

In this embodiment of the invention, air is drawn from within the cowling 26*a* directly into a throttle body 68*a* (having a throttle valve positioned therein, as described above) which leads to a surge tank 72*a*. The surge tank 72*a* is positioned at the end of the engine 22*a* generally opposite the cylinder head 46*a* and thus near the crankcase. In this embodiment, the intake runners 74*a* extend from the surge tank 72*a* around the crankcase end of the engine 22*a* and along the side of the engine to the cylinder head 46*a*.

In this embodiment, there is no silencer, the surge tank 72*a* being of a single large volume. As in the previous embodiment, however, a fuel supply unit 88*a* of the fuel supply system is preferably positioned between the crankcase cover 58*a* and the portion of the intake system (the surge tank 72*a*) at the crankcase end crankcase of the engine 22*a* opposite the cylinder head 46*a*.

This arrangement has similar benefits to the last embodiment. In this embodiment, however, the construction and assembly of the intake system is simplified by providing only a surge tank 72*a* (and no silencer). In addition, the runners 74*a* may be formed integrally with the surge tank 72*a*.

Figure 6A:
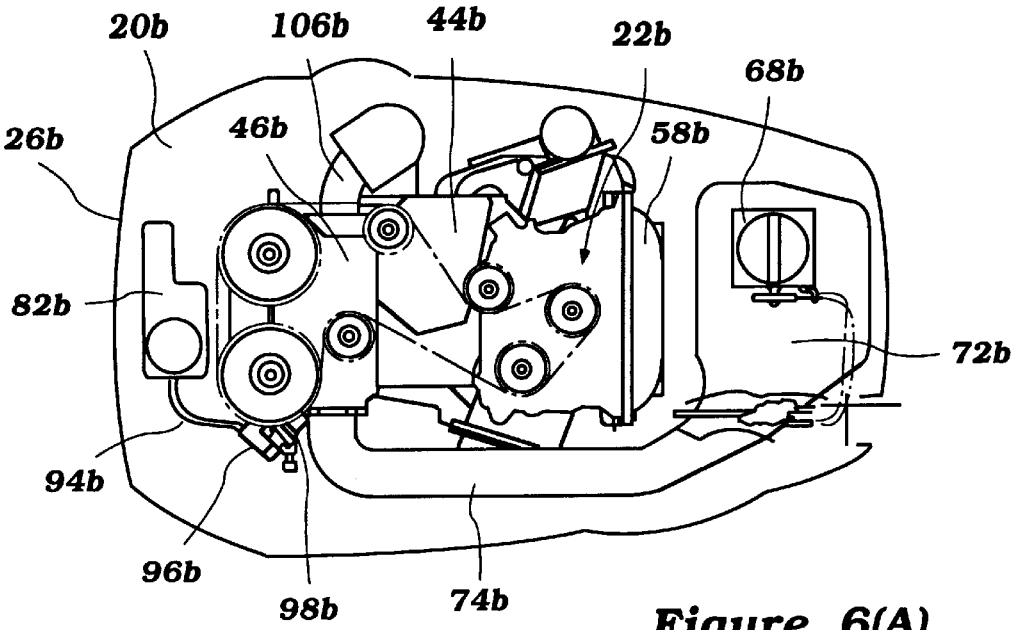
FIG. 6(A) is a top view of an engine arranged in accordance with a third embodiment of the present invention, with a cowling of a motor in which the engine is positioned illustrated in cross-section.
Figure 6B:
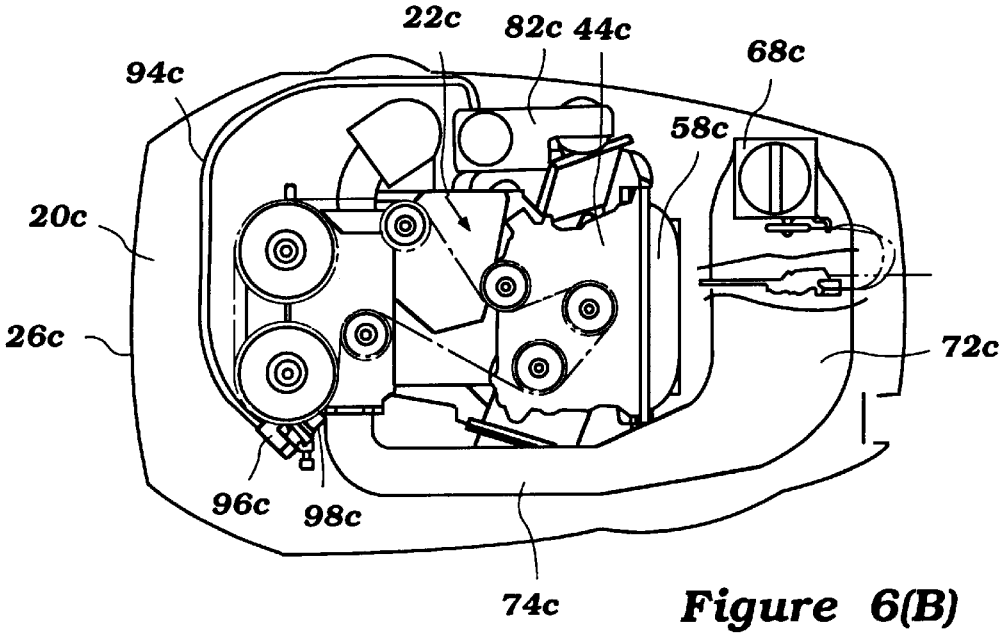
FIG. 6(B) is a top view of an engine arranged in accordance with a fourth embodiment of the present invention, with a cowling of a motor in which the engine is positioned illustrated in cross-section.

FIG. 6(*a*) illustrates an engine 22*b* arranged in accordance with a third embodiment of the present invention and utilized to power an outboard motor 20*b*. In the description and illustration of this embodiment, like reference numerals are used with like or similar parts to those used in the description and illustration of the above embodiments, except that a "b" designator has been added to all reference numerals of this embodiment.

This embodiment is similar to the last, where the intake system does not include a silencer, but only a surge tank 72*b*. In this embodiment, however, the fuel supply unit 82*b* is positioned at the end of the engine 22*b* adjacent the cylinder head 46*b*, and thus opposite the surge tank 72*b*.

Advantageously, in this embodiment the fuel supply unit 82*b* is positioned at the end of the engine 22*b*, thus minimizing the width of the engine. Also, this positioning of the fuel supply unit 82*b* lends to a symmetrical engine layout.

FIG. 6(*b*) illustrates an engine 22*c* arranged in accordance with a fourth embodiment of the present invention and utilized to power an outboard motor 20*c*. In the description and illustration of this embodiment, like reference numerals are used with like or similar parts to those used in the description and illustration of the above embodiments, except that a "c" designator has been added to all reference numerals of this embodiment.

This embodiment engine arrangement is similar to that illustrated in FIG. 6(*a*), except that the fuel supply unit 82*c* is positioned along the side of the engine 22*c* opposite the side along which the intake runners 74*c* extend. The high pressure delivery line 94*c* extends from the supply unit 82*c* along the side of the engine 22*c* and around the end where the cylinder head 46*c* is mounted to the fuel rail 96*c*.

Advantageously, the length of the engine 22*c* is reduced in this embodiment. Further, the positioning of the fuel supply unit 82*c* opposite the intake runners 74*c* lends to a symmetrical engine layout (i.e. about an axis extending through the engine from end to end).

Figure 7A:
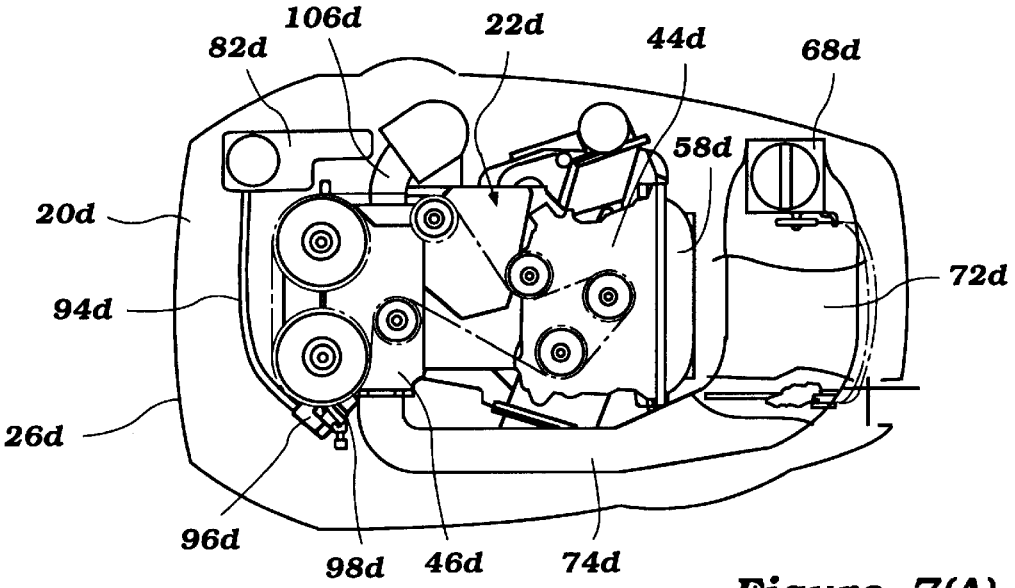
FIG. 7(A) is a top view of an engine arranged in accordance with a fifth embodiment of the present invention, with a cowling of a motor in which the engine is positioned illustrated in cross-section.
Figure 7B:
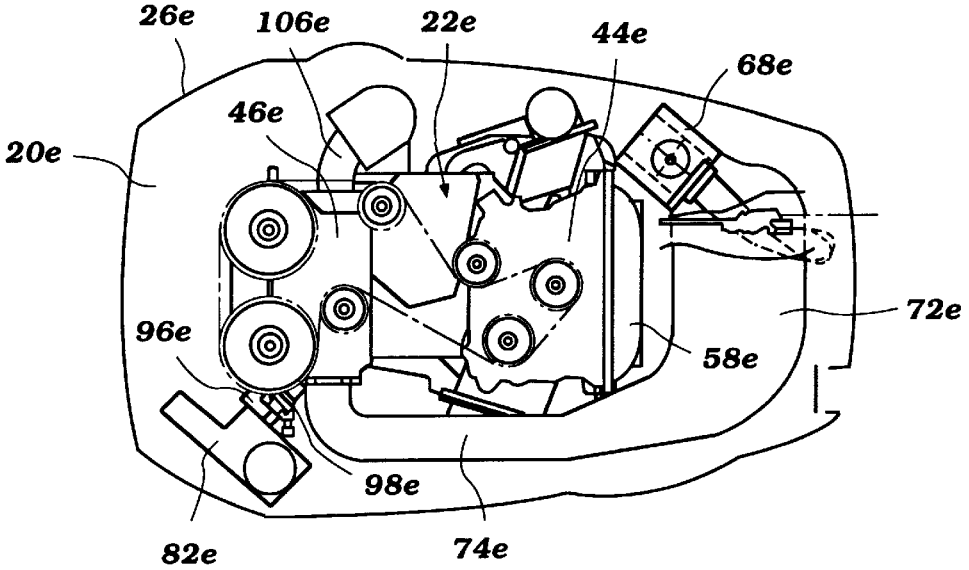
FIG. 7(B) is a top view of an engine arranged in accordance with a sixth embodiment of the present invention, with a cowling of a motor in which the engine is positioned illustrated in cross-section.

FIG. 7(*a*) illustrates an engine 22*d* arranged in accordance with a fifth embodiment of the present invention and utilized to power an outboard motor 20*d*. In the description and illustration of this embodiment, like reference numerals are used with like or similar parts to those used in the description and illustration of the above embodiments, except that a "d" designator has been added to all reference numerals of this embodiment.

This embodiment is similar to that illustrated in FIGS. 6(*a*) and (*b*), except that the fuel supply unit 82*d* is positioned at a corner of the engine 22*d* formed at the intersection of the side of the engine 22*d* opposite the side the intake runners 74*d* extend along, and the end of the engine 22*d* where the cylinder head 46*d* is positioned. As in the last embodiment, the high pressure delivery line 94*d* extends from the fuel supply unit 82*d* along the end of the engine 22*d* adjacent the cylinder head 46*d* to the fuel rail 96*d*.

Advantageously, this positioning of the fuel supply unit 82*d* lends to a compact engine arrangement since the unit 82*d* generally does not significantly increase the length or width of the engine 22*d*.

FIG. 7(*b*) illustrates an engine 22*e* arranged in accordance with a sixth embodiment of the present invention and utilized to power an outboard motor 20*e*. In the description and illustration of this embodiment, like reference numerals are used with like or similar parts to those used in the description and illustration of the above embodiments, except that an "e" designator has been added to all reference numerals of this embodiment.

In this embodiment, the fuel supply unit 82*e* is positioned at the corner of the engine 22*e* where the fuel rail 96*e* is positioned (i.e. where the end of the engine 22*e* where the cylinder head 46*e* is positioned and the side of the engine 22*e* along which the intake runners 74*e* extend meet). In this embodiment, the surge tank 72*e* is preferably arranged to extend along the crankcase end of the engine 22*e* towards the opposite corner from the fuel supply unit 82*e*. The throttle body 68*e* is preferably positioned at that portion of the surge tank 72*e* positioned at the corner of the engine 22*e*.

In the preferred embodiment of this arrangement, the supply unit 82*e* and fuel rail 96*e* are formed integrally, eliminating a number of the parts which are needed to mount these members individually, and reducing the number of fuel lines or hoses necessary in the fuel system.

Figure 8:
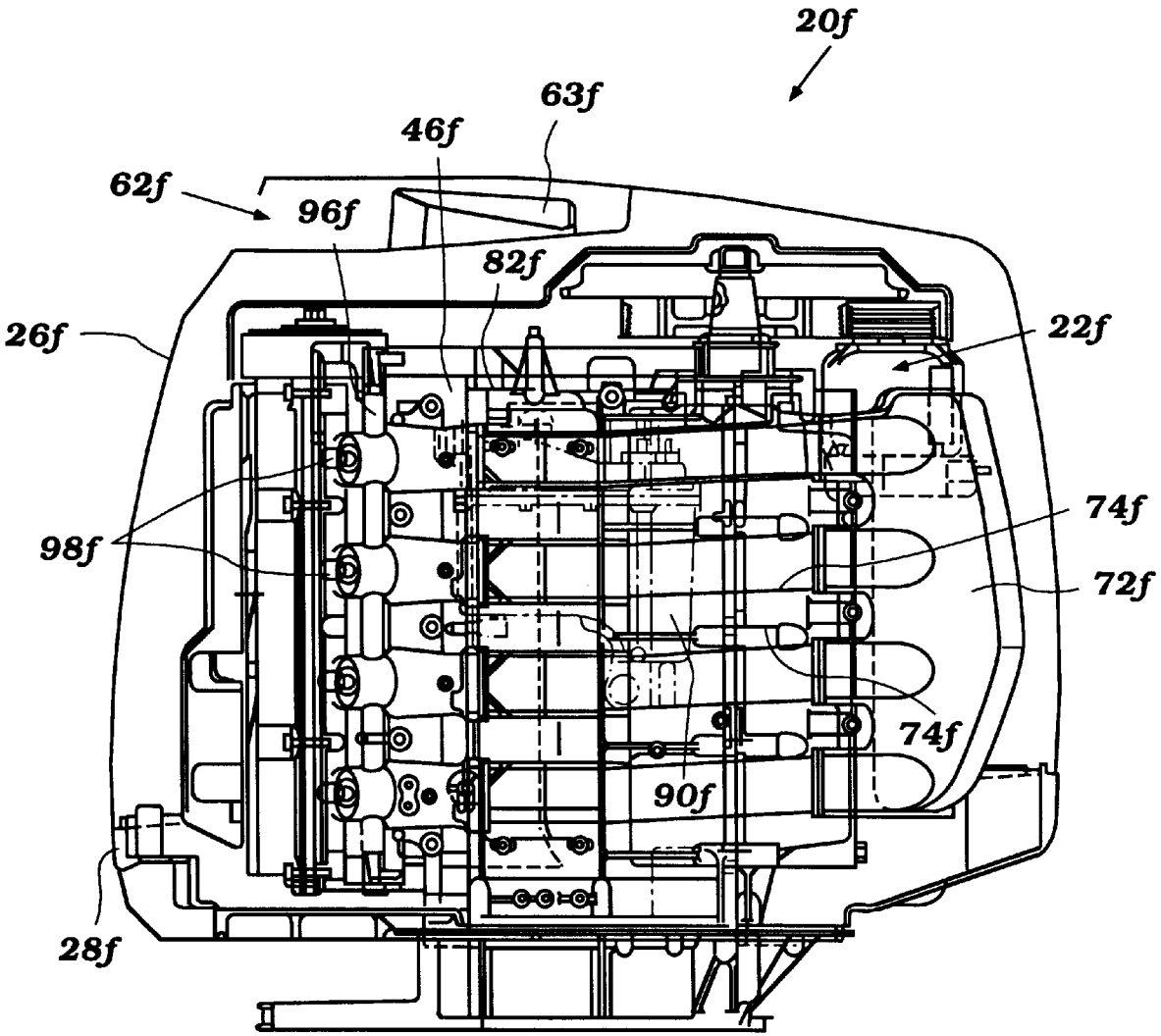
FIG. 8 is a cross-sectional side view of a top portion of an outboard motor powered by an engine arranged in accordance with a seventh embodiment of the present invention.
Figure 9:
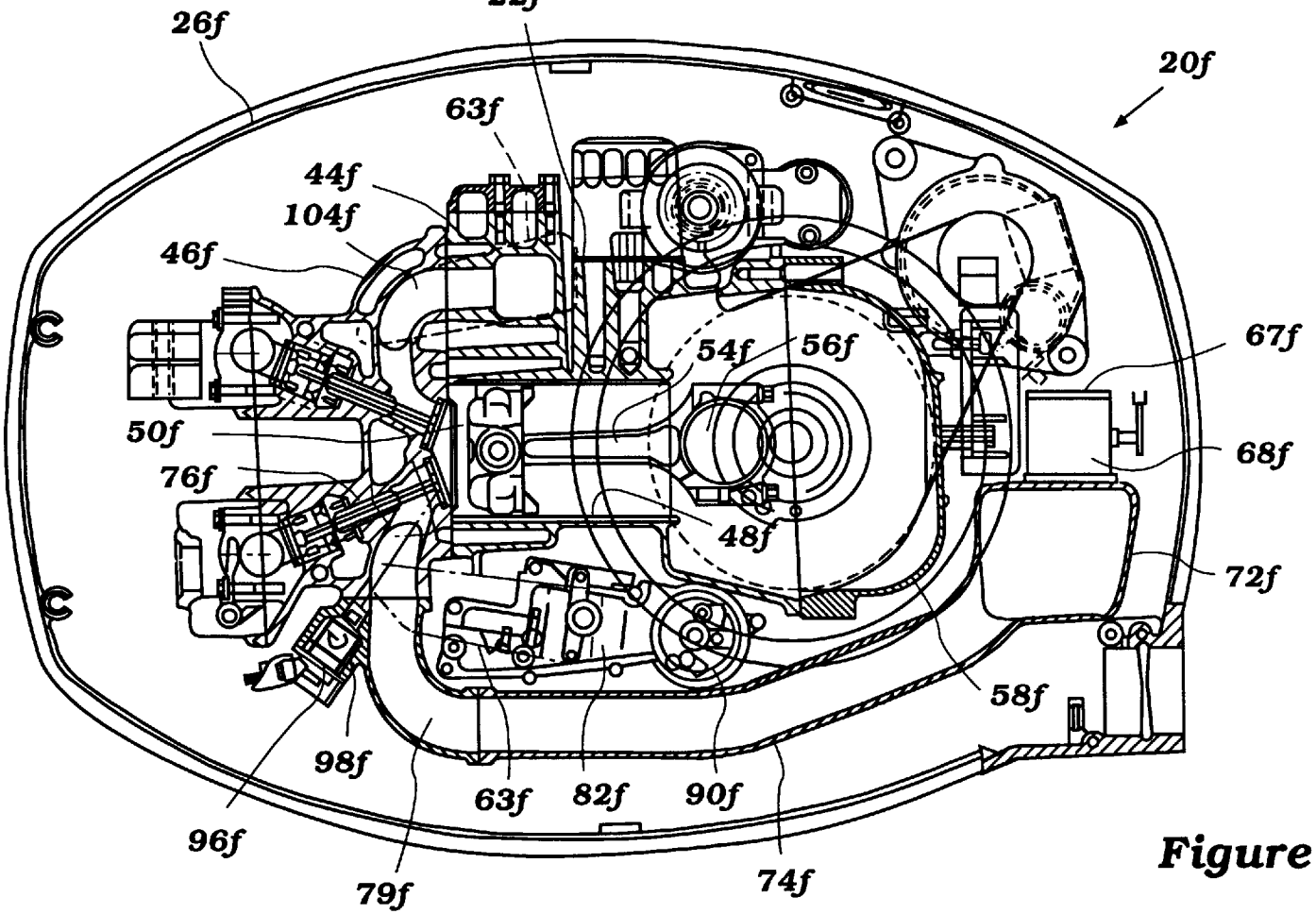
FIG. 9 is a cross-sectional top view of the engine illustrated in FIG. 8.

FIGS. 8 and 9 illustrate an engine 22*f* arranged in accordance with a seventh embodiment of the present invention and utilized to power an outboard motor 20*f*. In the description and illustration of this embodiment, like reference numerals are used with like or similar parts to those used in the description and illustration of the above embodiments, except that an "f" designator has been added to all reference numerals of this embodiment.

In this embodiment, air is drawn through a vent 62*f* near the top of the cowling 26*f* and then through a pair of intakes 63*f* formed in an engine cover portion of the cowling. The air is then drawn across the top of the engine 22*f* to an inlet 67*f* to the throttle body 68*f*. The throttle body 68*f* leads into a surge tank 72*f* positioned at the crankcase end of the engine 22*f* opposite the cylinder head 46*f*.

Intake runners 74*f* extend along the side of the engine 22*f* from the surge tank 72*f*. The runners 74*f* are spaced from the side of the engine 22*f*, with an intake mounting part 75*f* extending from each runner 74*f* to a respective intake passage 76*f* leading through the cylinder head 46*f* to a cylinder 48*f*. As illustrated, each mounting part 75*f* has a passage therethrough aligned with the passage through the runner 74*f* and the intake passage 76*f*. Preferably, the mounting part 75*f* includes a fuel injector mounting boss to which the fuel injector 98*f* is connected.

In this embodiment, the fuel supply unit 82*f* is preferably positioned along the side of the engine 22*f* between the engine 22*f* and the runners 74*f*. Preferably, the remainder of the fuel supply system is similar to that illustrated in FIG. 4.

Advantageously, the fuel supply unit 82*f* is positioned in the otherwise unoccupied space between the runners 74*f* and the engine 22*f*. This arrangement also permits the runners 74*f* to have a long length (increasing low engine speed performance) with a low radius of curvature (reducing friction losses).

Of course, the foregoing description is that of preferred embodiments of the invention, and various changes and modifications may be made without departing from the spirit and scope of the invention, as defined by the appended claims.

What is claimed is:

1. A fuel system arrangement for an engine positioned in a cowling of an outboard motor, said engine having a first end and a second end and comprising a cylinder block, a cylinder head connected to said cylinder block at said first end of said engine and cooperating with said cylinder block to define at least one combustion chamber, a crankcase positioned at said second end of said engine, an intake system for providing air to said combustion chamber, said intake system including at least one intake runner extending along a side of said engine defined between said first and second ends of said engine, said runner having a passage therethrough leading to a passage extending through said cylinder head to said combustion chamber, said fuel system including a fuel supply unit for delivering fuel from a fuel supply to at least one charge former, said charge former arranged to provide fuel to said combustion chamber for combustion therein, said fuel supply unit including, at least, first pump means, a vapor separator, said first pump means drawing fuel from said fuel supply and delivering it to said vapor separator and second pump means for delivering fuel from said vapor separator to said at least one charge former, said fuel supply unit positioned at one of said first and said second ends of said engine.

2. The fuel system in accordance with claim 1, wherein said fuel supply unit includes a filter element positioned along a fuel line extending from said fuel supply to said first pump means.

3. A fuel system arrangement for an engine positioned in a cowling of an outboard motor, said engine having a first end and a second end and comprising a cylinder block, a cylinder head connected to said cylinder block at said first end of said engine and cooperating with said cylinder block to define at least one combustion chamber, a crankcase positioned at said second end of said engine, an intake system for providing air to said combustion chamber, said intake system including a surge tank positioned at said second end of said engine and at least one intake runner extending along a side of said engine defined between said first and second ends of said engine, said runner having a passage therethrough leading to a passage extending through said cylinder head to said combustion chamber, said runner extending from said surge tank to said cylinder head, said fuel system including a fuel supply unit for delivering fuel from a fuel supply to at least one charge former, said charge former arranged to provide fuel to said combustion chamber for combustion therein and wherein said fuel supply unit is positioned between said surge tank and said cylinder block.

4. A fuel system arrangement for an engine positioned in a cowling of an outboard motor, said engine having a first end and a second end and comprising a cylinder block, a cylinder head connected to said cylinder block at said first end of said engine and cooperating with said cylinder block to define at least one combustion chamber, a crankcase positioned at said second end of said engine, an intake system for providing air to said combustion chamber, said intake system including an intake silencer positioned at said second end of said engine, a passage extends from said silencer to a surge tank positioned along said side of said engine, and said runner extends from said surge tank to said cylinder head, said fuel system including a fuel supply unit for delivering fuel from a fuel supply to at least one charge former, said charge former arranged to provide fuel to said combustion chamber for combustion therein and wherein said fuel supply unit is positioned between said silencer and said cylinder block.

5. A fuel system arrangement for an engine positioned in a cowling of an outboard motor, said engine having a first end and a second end and comprising a cylinder block, a cylinder head connected to said cylinder block at said first end of said engine and cooperating with said cylinder block to define at least one combustion chamber, a crankcase positioned at said second end of said engine, an intake system for providing air to said combustion chamber, said intake system including at least one intake runner extending along a side of said engine defined between said first and second ends of said engine, said runner having a passage therethrough leading to a passage extending through said cylinder head to said combustion chamber, said fuel system including a fuel supply unit for delivering fuel from a fuel supply to at least one charge former, said charge former arranged to provide fuel to said combustion chamber for combustion therein and comprising a fuel injector, and wherein said fuel supply unit is positioned at one of said first and said second ends of said engine, said fuel system includes a fuel rail for delivering fuel to said injector and a high pressure fuel line extending from said fuel supply unit to said fuel rail.

6. The fuel system in accordance with claim 1, wherein said cowling has a first end facing a watercraft to which said motor is coupled and wherein said second end of said engine faces said first end of said cowling.

* * * * *